US011166536B2

(12) United States Patent
Wang et al.

(10) Patent No.: US 11,166,536 B2
(45) Date of Patent: Nov. 9, 2021

(54) PACKAGING

(71) Applicant: The Procter & Gamble Company, Cincinnati, OH (US)

(72) Inventors: Huiyi Wang, Beijing (CN); Weiyi Peng, Zhanjiang (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/024,797

(22) Filed: Sep. 18, 2020

(65) Prior Publication Data

US 2021/0076797 A1 Mar. 18, 2021

(30) Foreign Application Priority Data

Sep. 18, 2019 (WO) ..... PCT/CN2019/106325

(51) Int. Cl.
*A45D 34/04* (2006.01)
*A45D 40/26* (2006.01)

(52) U.S. Cl.
CPC ..... *A45D 34/04* (2013.01); *A45D 34/045* (2013.01); *A45D 40/26* (2013.01); *A45D 40/265* (2013.01)

(58) Field of Classification Search
CPC .... A45D 34/04; A45D 34/041; A45D 34/042; A45D 34/043; A45D 34/045; A45D 34/046; A45D 40/26; A45D 40/261; A45D 40/262; A45D 40/264; A45D 40/265; A45D 40/267; B65B 7/28; B65B 7/16; B65B 7/165; B65B 7/168; B65B 51/04
USPC ... 215/42, 43, 202, 216, 317, 320, 321, 353, 215/263; 206/457
See application file for complete search history.

(56) References Cited

U.S. PATENT DOCUMENTS

| | | | | |
|---|---|---|---|---|
| 4,387,818 | A * | 6/1983 | Conti | B65D 41/485 215/256 |
| 4,802,438 | A | 2/1989 | Dejonge | |
| 5,096,077 | A * | 3/1992 | Odet | B65D 47/0838 215/211 |
| 5,314,084 | A * | 5/1994 | Folta | B65D 51/241 215/249 |
| 7,204,381 | B2 * | 4/2007 | Vincent, III | B65D 35/08 215/44 |
| 2017/0135458 | A1 | 5/2017 | Thorez et al. | |

FOREIGN PATENT DOCUMENTS

| | | | |
|---|---|---|---|
| CN | 204682841 | U | 10/2015 |
| CN | 208683343 | U | 4/2019 |
| CN | 109998261 | A | 7/2019 |
| CN | 110040354 | A | 7/2019 |
| CN | 209225728 | U | 8/2019 |
| JP | H07315414 | A | 12/1995 |
| JP | H09313246 | A | 12/1997 |

OTHER PUBLICATIONS

PCT Search Report and Written Opinion for PCT/CN2019/106325 dated Jun. 17, 2020.
U.S. Appl. No. 29/716,949, filed Dec. 13, 2019, U-Ping Loh et al.

* cited by examiner

*Primary Examiner* — David J Walczak
(74) *Attorney, Agent, or Firm* — John G. Powell

(57) ABSTRACT

A shoulder that is functionally attached to a container body and neck provides a desirable aesthetics to packaging, particularly packaging suitable for personal care products.

18 Claims, 8 Drawing Sheets

PACKAGING

FIELD OF THE INVENTION

The present invention is directed to packaging, especially packaging for personal care products.

BACKGROUND OF THE INVENTION

The aesthetics of a personal care product are important to users connoting quality and effectiveness of the personal care composition contained. One example of a personal care product is one having a container body (containing the composition) having a neck in fluid communication to the container body at the top of the container body. The neck has a neck opening and a dispenser (e.g., dosing pipette dispenser) that is releasably affixed to the neck and in fluid communication, through the neck opening, with the contents contained in the container body. The dispenser can dispense the contained personal care composition to a target surface such as facial skin. Furthermore, some of these products may have a shoulder that provides a transition in-between the container body and the releasably affixed dispenser. The principle purpose of the shoulder is to provide an aesthetic pleasing transition between the top portion of the container body and the dispenser (releasably affixed to the neck). This type of personal care product is typically common in the skin care product category where aesthetics are particularly important to users.

The shoulder, as a separate component, is affixed to the container body and/or neck. The shoulder is mechanically affixed to minimize movement in the longitudinal and rotational directions. Referencing the longitudinal direction, the neck has a neck ring circumferentially around the exterior of the neck, typically below any threading. The shoulder has a so called "snap ring" having teeth that flex over the neck ring to have the shoulder functionally attach to the neck, and to mechanically prohibit the shoulder from subsequently being pulled up over from the neck. Referencing the rotational direction, the container body has depressions on either side of the neck formed along a molding seam. These depressions pose manufacturing challenges in molding typically requiring a three-piece mold (vs. two) in making the container body having these depressions, especially if the container body is made from molded glass. To restrict the shoulder from rotating around the neck, the shoulder has a protrusion, opposing the snap ring, that engages in the corresponding depressions of the container body. Glue is typically added in the container body depressions to help affix the corresponding shoulder protrusions.

There is a need for a system to attach a shoulder to the container body and/or neck, wherein the container and neck that can be molded by using a two-piece mold (vs. three or more) with regular molding machine (vs. specialized machine for 3-piece mold) that does not pose challenges in de-molding, i.e., ejecting the container body and neck from the mold. Such a system may provide greater efficiency, reliability, manufacturing tolerances, and/or more cost effectiveness.

SUMMARY OF THE INVENTION

The present invention attempts to address one or more of these needs. Surprisingly the use of a protrusion (on the top portion of a container body) and notching tooth (of the interior concentric opening of a shoulder), which are configured to engage each other, helps the shoulder remain functionally attached to a container body and neck. One aspect of the invention provides for a package, preferably for a personal care product. The package comprises a longitudinal axis and a container body that can contain a personal care composition. The container body comprises a top portion circumscribing the longitudinal axis. The top portion comprises a first protrusion disposed thereon. A neck extends from the top portion along the longitudinal axis. The neck comprises a neck opening in fluid communication with an interior of the container body, and a neck ring at least partially extending circumferentially around an exterior of the neck. A shoulder comprises a plurality of teeth defining an interior concentric opening in an interior of the shoulder. The plurality of teeth comprises: a first flexing tooth configured to flex over and engage with the neck ring, and a first notching tooth configured to engage the first protrusion, when the shoulder is functionally attached to the container body and neck.

An advantage of the present package is having a system between the shoulder and the container body and neck, minimizing a rotational degree of freedom. This provides for a product that has more reliability in the integrity of these components withstanding the rigors of manufacturing, transportation, and user usage. This advantage is particularly noteworthy when the container body and neck are a different material than the shoulder. Indeed, affixing components of different materials poses additional challenges as compared to affixing components of the same material. Thus, the present product is particularly advantageous when the container and neck are made from glass and the shoulder is made from plastic.

These and other features of the present invention will become apparent to one skilled in the art upon review of the following detailed description when taken in conjunction with the appended claims.

BRIEF DESCRIPTION OF THE DRAWINGS

While the specification concludes with claims particularly defining and distinctly claiming the invention, it is believed that the invention will be better understood from the following description of the accompanying figures. In the accompanying figures:

DETAILED DESCRIPTION OF THE INVENTION

Definitions

All percentages, parts and ratios are based upon the total weight of the compositions of the present invention, unless otherwise specified. All such weights as they pertain to listed ingredients are based on the active level and, therefore do not include solvents or by-products that may be included in commercially available materials, unless otherwise specified. The term "weight percent" may be denoted as "wt %" herein. All molecular weights as used herein are weight average molecular weights expressed as grams/mole, unless otherwise specified.

As used herein, the articles including "a" and "an" when used in a claim, are understood to mean one or more of what is claimed or described.

As used herein, the terms "comprise", "comprises", "comprising", "include", "includes", "including", "contain", "contains", and "containing" are meant to be non-limiting, i.e., other steps and other sections which do not affect the end of result can be added. The above terms encompass the terms "consisting of" and "consisting essentially of".

As used herein, the words "preferred", "preferably" and variants refer to embodiments of the invention that afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.

Figure 1:
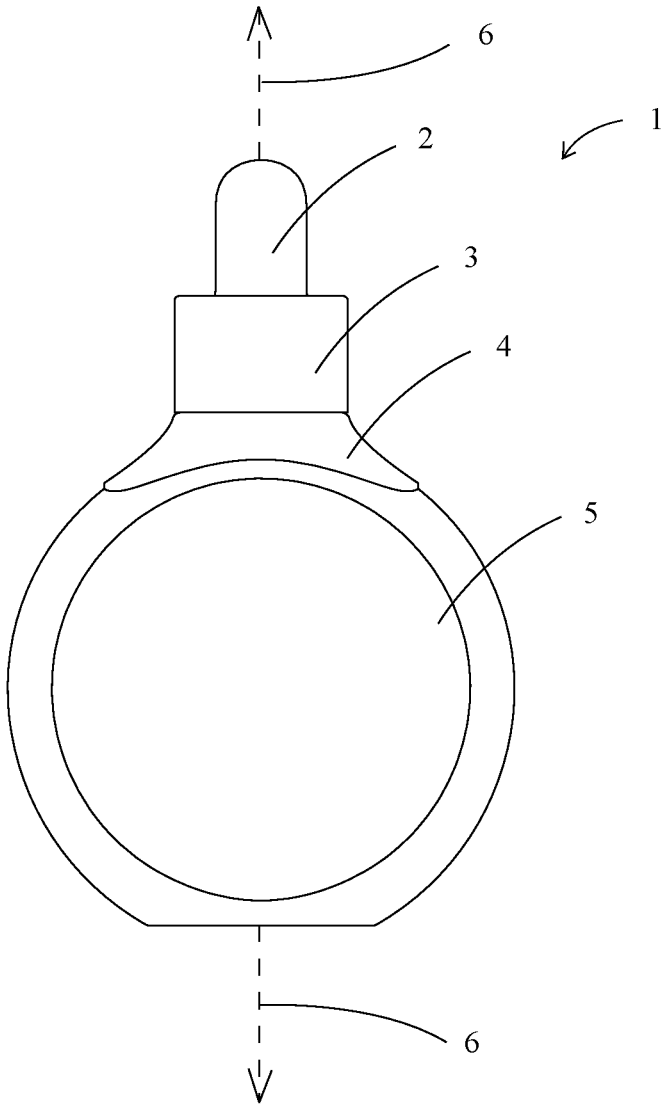
FIG. 1 is a front view of an assembled package.

FIG. 1 is a front view of an assembled package (1) suitable for a personal care product. A longitudinal axis (6) is along the length (i.e., longest dimension) of the package. A container body (5) can contain a personal care composition (in the interior of the container body (5)). A portion of the dispenser (12) is releasably affixed to the container body (5), with a squeezable bulb (2) and collar (3) are visible and have rotational symmetry around the longitudinal axis (6). A shoulder facia (4) provides an aesthetic effect by providing a visually appealing transition from the releasably attached dispenser (12) and the container body (5). One particularly preferred example of a personal care composition is a skin care composition. In turn, examples of a skin care composition include a serum or an essence. Suitable non-limiting examples of skin care compositions are those sold under the trademarks of OLAY and SK-II.

Figure 2:
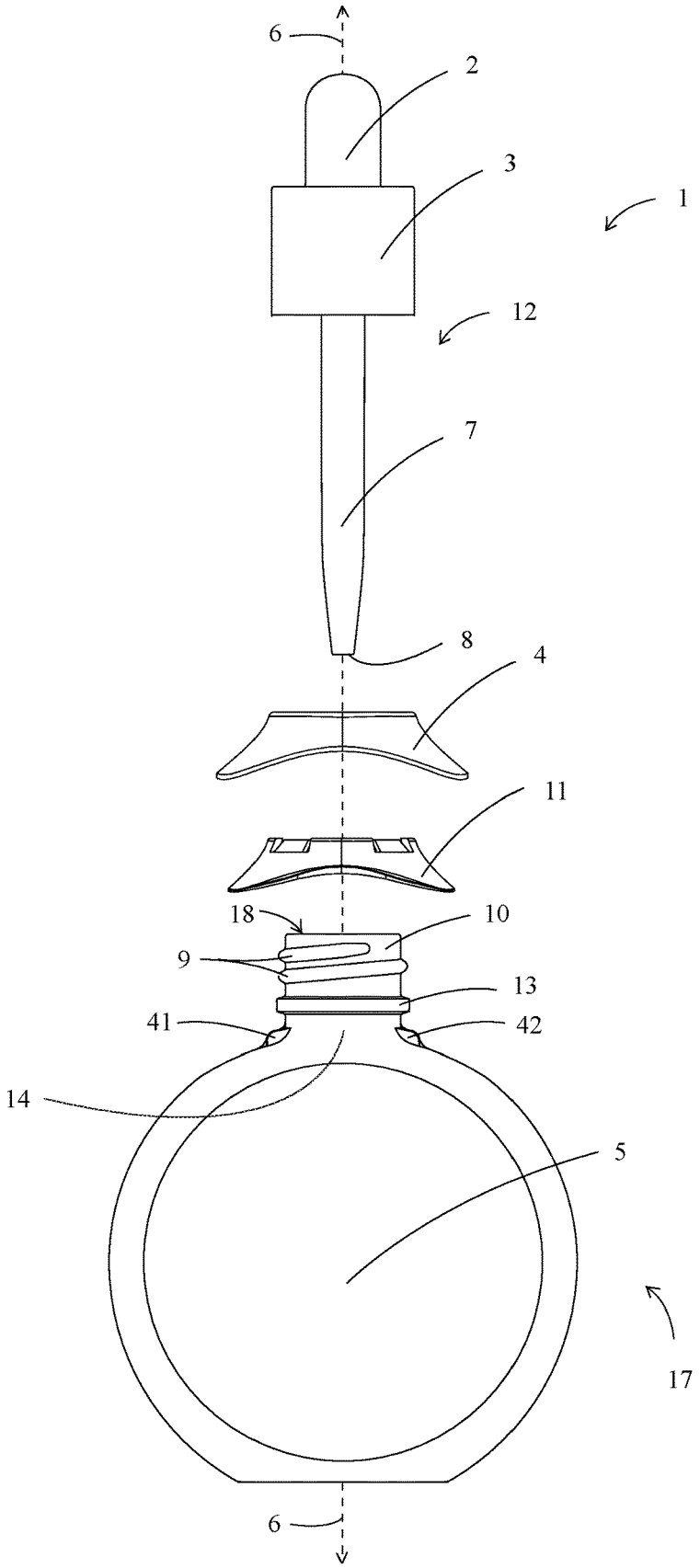
FIG. 2 is a front view of an exploded view of the assembled package of FIG. 1, with specific mention to a shoulder this is otherwise functionally attached to a container.

FIG. 2 is a front view of an exploded view of the assembled package (1) of FIG. 1, with specific mention to a shoulder (11), which is otherwise functionally attached to a container (17). Containers can be of any shape, size, or configuration. That is, containers may have symmetry (e.g., bilateral symmetry) or not at all. The volume containable within the container, for example, can be from 5 ml to 500 ml, preferably from 10 ml to 400 ml, alternatively from 15 ml to 300 ml. The earlier described shoulder fascia (4) is attached (e.g., glue or adhesive) over (i.e., exterior surface) of the functionally attached shoulder (11). The package (1) comprises a longitudinal axis (6). The package (1) comprises a container (17), which comprises a longitudinal axis (6) and a container body (5). The container body (5) can contain a personal care composition. The container body (5) comprises a top portion (14) circumscribing the longitudinal axis (6), wherein the top portion comprises at least first protrusion (41), preferably a first protrusion (41) and a second protrusion (42) disposed thereon. The top portion (14) of the container body (5) is opposing (along longitudinal axis (6)) the bottom portion (not shown) of the container body (5). The longitudinal axis (6) is orthogonal to the planar surface of the container body (5) that contacts the shelf surface. It is the bottom portion that is nearest, and makes contact, with a shelf/table top surface when the package (1) is in its intended upright position. A neck (10) extends from the top portion (14) of the container body (5) along the long the longitudinal axis (6). The neck (10) further comprising a neck opening (18) that is in fluid communication with an interior of the container body (5). The neck opening (18) has a centroid in which the longitudinal axis (6) intersects. Preferably the neck opening (18) has a circular cross section (taken in a plane which the longitudinal axis (6) orthogonally intersects). A neck ring (13) at least partially extends, preferably fully extends, around the exterior of the neck (10). Preferably the neck ring (13) extends circumferential in a plane which the longitudinal axis (6) orthogonally intersects. The neck (10) further comprises neck threading (9) that extends around the exterior of the neck (10). The neck ring (13) is below (along the longitudinal axis (6)) the neck threading (9). The first and second protrusions (41, 42) are on the top portion (14) of the container body (5) adjacent the neck (10).

Still referring to FIG. 2, a shoulder (11) is functionally attached to the container body (5) and neck (10). The shoulder fascia (4) is attached over the functionally attached shoulder (11). The shoulder fascia (4) typically made of plastic and has a desirable color or polish that compliments other aesthetic features of the package (1). The shoulder fascia (4) generally mimics the shape of the shoulder (11) (e.g., also having an interior concentric opening (not shown) and a skirt portion (not shown). However, the should fascia (4) may not have teeth defining the interior concentric opening. This is because of the aesthetic function of the shoulder fascia (4).

Still referring to FIG. 2, a dispenser (12) can be removably attached to the neck (10) and is in fluid communication with the interior of the container body (5). The dispenser (12) may comprise a pipette (7) and a squeezable bulb (2) wherein the squeezable bulb (2) is opposing a pipette opening (8) of the pipette (7). A user can squeeze the squeezable bulb (2) and create a vacuum when releasing the squeeze on the squeezable bulb (2) to have the dispenser (12) withdraw the personal care composition (not shown) contained in the container body (5). Thereafter, the user can direct the dispenser to a target surface (e.g., skin surface) and then again squeeze the squeezable bulb (2) again to evacuate the personal care composition contained in the dispenser (12) to the target surface (not shown). Preferably, as shown in FIG. 2, the dispenser (12) further comprises a collar (3), wherein the collar (3) is in-between the squeezable bulb (2) and the pipette opening (8). It is the pipette opening (8) which the personal care composition enters and exits the dispenser (12). The pipette opening (8) is typically reaches to the bottom, or near the bottom, of the interior of the container body (5) (containing the personal care composition). The dispenser (12) of FIG. 2 has rotational symmetry around the longitudinal axis (6). Although not shown, preferably the collar (3) is threaded in an inside surface. As previously described, the neck (10) comprises a neck threading (9) on said exterior of the neck (10) which corresponds to the threading of the collar (3). A user may twist the dispenser (12) to removably release the dispenser (12) from the neck (10). Preferably the dispenser (12) is releasably fluidly sealed to the neck (10) as to prevent any leakage in the event the package (1) is accidently tipped over. In another example, an auto-doser may be used as the dispenser or component of the dispenser (such auto-dosers available from manufacturers such as Aptar or FS Korea).

Figure 3:
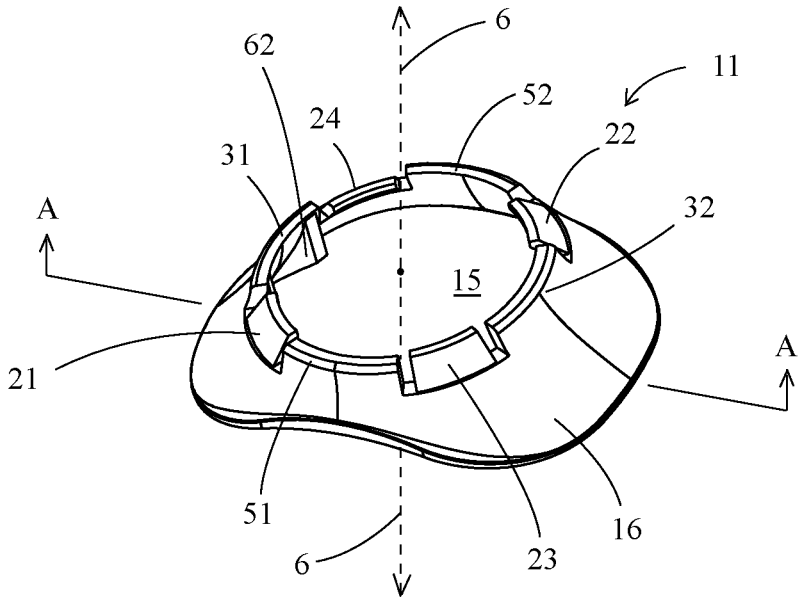
FIG. 3 is perspective top view of the shoulder of FIG. 2.

FIG. 3 is perspective top view of the shoulder (11) of FIG. 2. The shoulder (11) comprises a plurality of teeth defining an interior concentric opening (15) in an interior of the shoulder (11). The longitudinal axis (6) intersects at about the centroid of the interior concentric opening (15) (in a plane which the longitudinal axis (6) orthogonally intersects). The plurality of teeth comprises at least a first flexing tooth (21) configured to flex over and engage with the neck ring (13) of the neck (10) (wherein the neck ring (13) is described in previous FIG. 2 but not shown in FIG. 3). The plurality of teeth also comprises at least a first notching tooth (31) configured to engage the first protrusion (41) (wherein the first protrusion (41) is described in previous FIG. 2 but not shown in FIG. 3) when the shoulder (11) is functionally attached to the container body (5) and neck (10). Preferably the plurality of teeth further comprises a second notching tooth (32) configured to engage the second protrusion (42) (wherein the second protrusion (42) is described in previous FIG. 2 but not shown in FIG. 3) when the shoulder (11) is functionally attached to the container body (5) and neck (10). More preferably, as shown in FIG. 3, the first notching tooth (31) and the second notching tooth (32) are opposing each other in the interior concentric opening (15) in the interior of the shoulder (11). The first notching tooth (31) comprising a notch portion, which may include ribs with a second rib (62) partially visible in FIG. 3. In alternative examples, additional notching teeth are provided.

As shown in FIG. 3, preferably the plurality of teeth, defining the interior concentric opening (15), further comprise a second flexing tooth (22), preferably also a third flexing tooth (23), more preferably also a fourth flexing tooth (24). Each of these flexing teeth (22, 23, 24) configured to flex over and engage with the neck ring (13) (when the shoulder (11) is functionally attached to the container body (5) and neck (10). Alternatively, additional flexing teeth are provided. As shown in FIG. 3, preferably the plurality of teeth, defining the interior concentric opening (15), further comprise a first non-flexing tooth (51), preferably further comprising a second non-flexing tooth (52). More preferably the first non-flexing tooth (51) and the second non-flexing tooth (52) are opposing each other in the interior concentric opening (15) in the interior of the shoulder (11). A skirt portion (16) circumferentially extends outwardly from the interior concentric opening (15). Although not shown in FIG. 3, the skirt portion (16) contacts the top portion (14) of the container body (5) when the shoulder (11) is functionally attached to the container body (5) and neck (10). When functionally attached, the shoulder (11) covers at least the first protrusion (41), preferably the first and second protrusion (41, 42). Still referencing FIG. 3, a cross sectional cut is taken along plane AA (intersecting the longitudinal axis (6)) as provided in FIG. 4.

Figure 4:
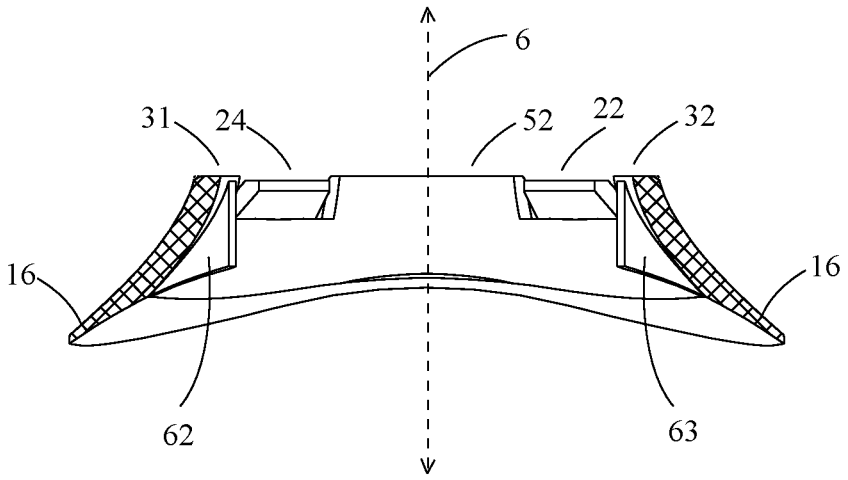
FIG. 4 is a side cross sectional view of the shoulder of FIG. 3.

FIG. 4 is a side view of the cross section of the shoulder (11) indicated in FIG. 3. The longitudinal axis (6) is intersected by a cross sectioning plane. This plane divides the interior concentric opening (15), and the first notching tooth (31) and the second notching tooth (32) into halves (wherein the first and second notching teeth (31, 32) are on opposing sides of the shoulder (11)). The first notching tooth (31) has a second rib (62) disposed in an underneath surface. Similarly, the second notching tooth (32) has a third rib (63) disposed in an underneath surface. These ribs (62, 63) form part of the respective notches of the first and second notching teeth (31, 32). In the middle of the interior concentric opening (15), and in-between the first and second notching teeth (31, 32), is a second non-flexing tooth (52). A non-flexing tooth does not flex, or at least does not substantially flex, over the subject neck ring. On either side of the second non-flexing tooth (52) is a fourth flexing tooth (24) and a second flexing tooth (22). A skirt portion (16) circumferentially extends outwardly from the interior concentric opening (15).

Figure 5:
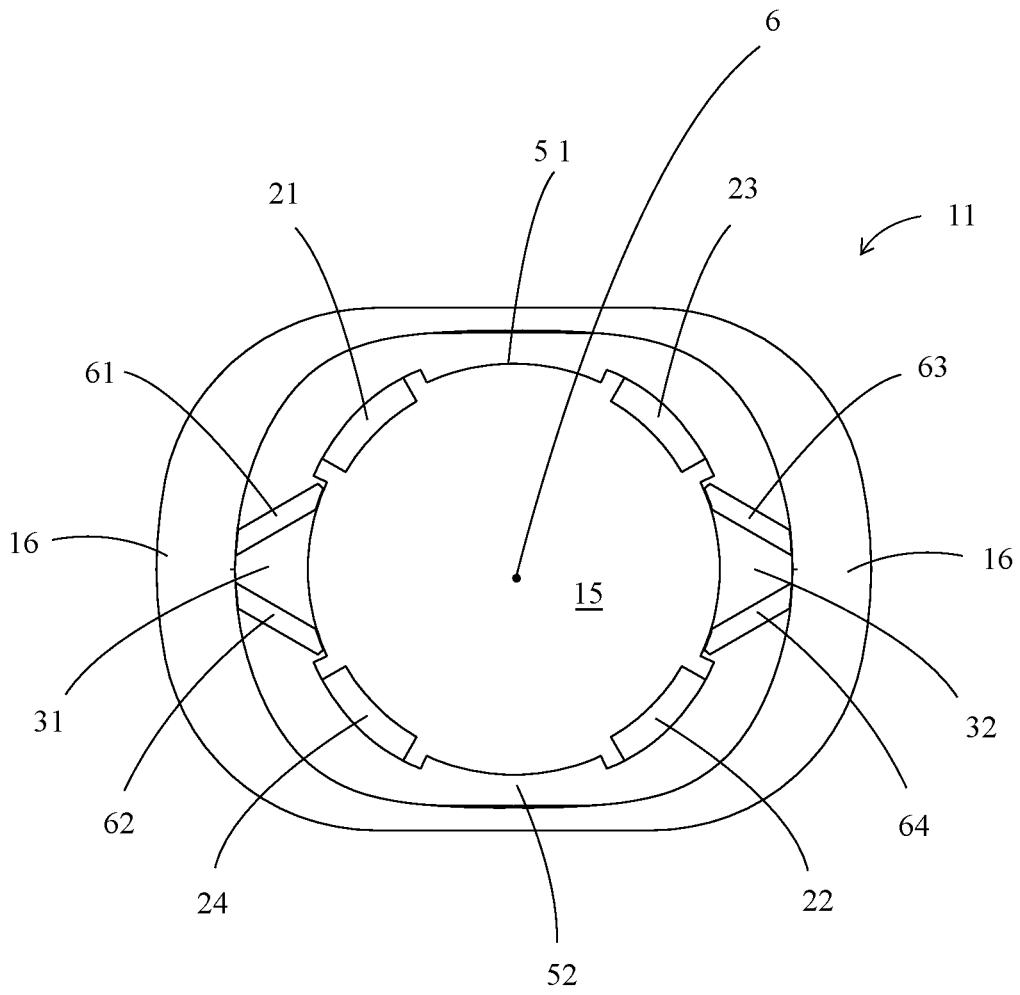
FIG. 5 is a bottom view of the shoulder of FIGS. 3 and 4.

FIG. 5 is a bottom view of the shoulder (11) of FIGS. 3 and 4. The shoulder (11) comprising a plurality of teeth defining an interior concentric opening (15) in an interior of the shoulder (11). The plurality of teeth comprises a first flexing tooth (21), a second flexing tooth (22), a third flexing tooth (23), and a fourth flexing tooth (24). The plurality of teeth further comprises a first non-flexing tooth (51) and a second non-flexing tooth (52), which are opposing each other in the interior concentric opening (15). The plurality of teeth yet also further comprises a first notching tooth (31) and a second notching tooth (32), which are opposing each other in the interior concentric opening (15). The flexing teeth (21, 22, 23, 24) are in-between the non-flexing teeth (51, 52) and the notching teeth (31, 32). The notching teeth (31, 32) each comprise a notch portion configured to engage the protrusions (41, 42) (but not shown in FIG. 5).

Still referring to FIG. 5 and turning to the first notching tooth (31) and the notch portion thereof, a first rib (61), more preferably a first rib (61) and a second rib (62) is disposed thereon. These ribs (61, 62) are disposed on the underneath surface of the first notching tooth (31). It is the underneath surface that faces the first protrusion (41) of the top portion (14) of the container body (5) when that shoulder (11) is functionally attached with the container body (5) and neck (10). Preferably, as in FIG. 5, the first and second ribs (61, 62) are opposing each other in angular relationship, more preferably a vertex of the angle defining the angular relationship of the opposing ribs (61, 62) is furthest from the longitudinal axis (6) (such that the angle of the ribs opens toward the longitudinal axis (6)). Preferably the angle is from 15 to 90 degrees, preferably 30 to 75 degrees. When the shoulder (11) is functionally attached, the first notching tooth (31), having the first and second ribs (61, 62) disposed on an underneath surface, engages the first protrusion (41). Preferably these ribs engage the first protrusion (41) on either side of the first protrusion (41). An analogy can be drawn to second notching tooth (32) (and the second protrusion (42)). The second notching tooth (32) and the notch portion thereof, a third rib (63), more preferably a third rib (63) and a fourth rib (64) is disposed thereon. These ribs (63, 64) are disposed on the underneath surface of the second notching tooth (32). It is the underneath surface that faces the second protrusion (42) of the top portion (14) of the container body (5) when the shoulder (11) is functionally attached with the container body (5) and neck (10). Preferably, as in FIG. 5, the third and fourth ribs (63, 64) are opposing each other in angular relationship, more preferably a vertex of an angle defining the angular relationship of the opposing ribs (61, 62) is furthest from the longitudinal axis (6) (such that the angle of the ribs opens toward the longitudinal axis (6)). Preferably the angle is from 15 to 90 degrees, preferably 30 to 75 degrees. When the shoulder (11) is functionally attached, the second notching tooth (32), having the third and fourth ribs (63, 64) disposed on an underneath surface, engages the second protrusion (42). Preferably these ribs engage the second protrusion (42) on either side of the second protrusion (42). A skirt portion (16) circumferentially extends outwardly from the interior concentric opening (15).

Figure 6:
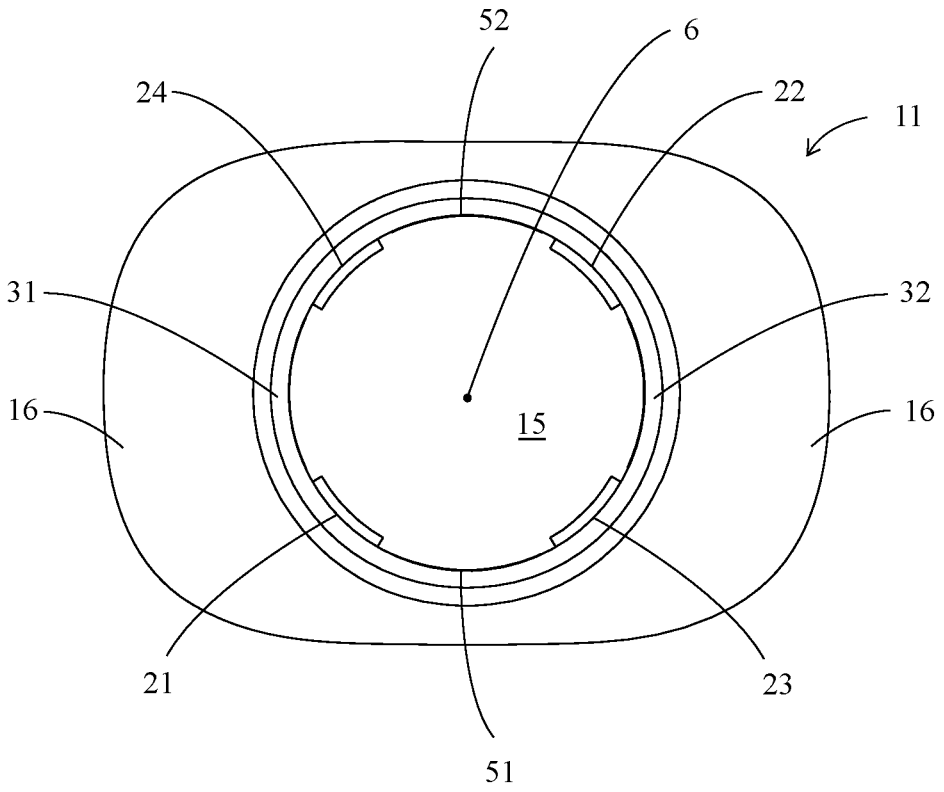
FIG. 6 is a top view of the shoulder of FIG. 5.

FIG. 6 is a top view of the shoulder of FIG. 5. The shoulder (11) comprising a plurality of teeth defining an interior concentric opening (15) in an interior of the shoulder (11). The plurality of teeth comprises a first flexing tooth (21), a second flexing tooth (22), a third flexing tooth (23), and a fourth flexing tooth (24). The plurality of teeth further comprises a first non-flexing tooth (51) and a second non-flexing tooth (52), which are opposing each other in the interior concentric opening (15). The plurality of teeth yet also further comprises a first notching tooth (31) and a second notching tooth (32), which are opposing each other in the interior concentric opening (15). The flexing teeth (21, 22, 23, 24) are in-between the non-flexing teeth (51, 52) and the notching teeth (31, 32). The notching teeth (31, 32) each comprise a notch portion configured to engage the protrusions (41, 42) (but not shown in FIG. 5). A skirt portion (16) circumferentially extends outwardly from the interior concentric opening (15).

Figure 7:
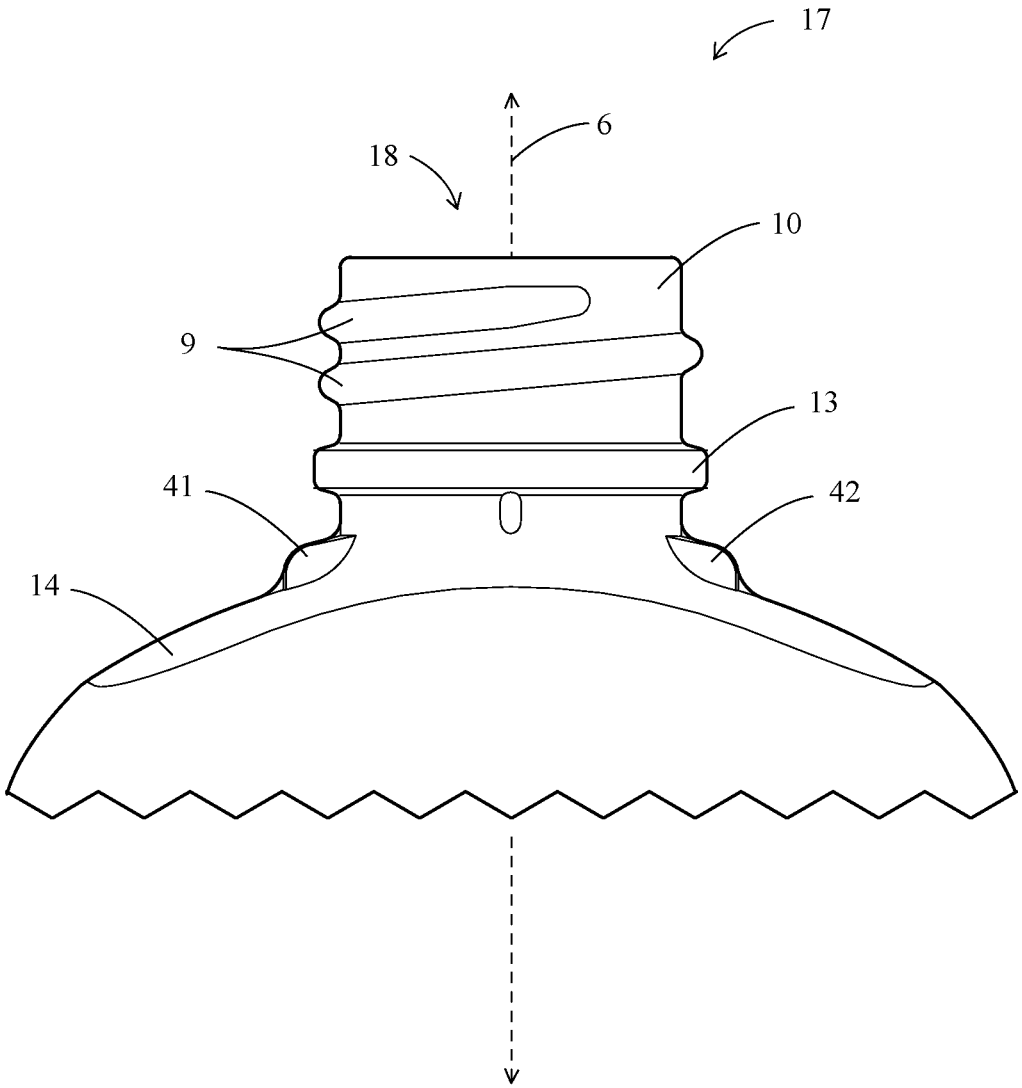
FIG. 7 is a front cut away view of a top portion of the container and neck of FIG. 2.
Figure 8:
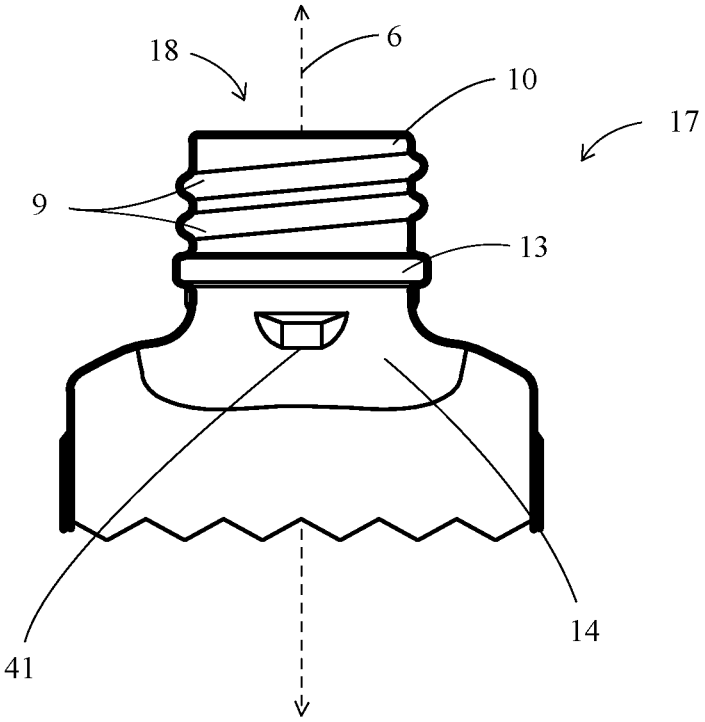
FIG. 8 is a side cut away view of the top portion of the container and neck of FIG. 7

FIG. 7 is a front cut away view of a top portion of the container (17), focusing on the top portion (14) of the container body (5) and the neck (10) extending from the top portion (14), as in FIG. 2. FIG. 8 is a left side view of FIG. 7. Accordingly, FIGS. 7 and 8 are collectively discussed. The longitudinal axis (6) is along the length of the container (17). The neck (10) comprises a neck opening (18) that is in fluid communication with the interior of the container body (5). The neck opening (18) has a centroid (not shown), which the longitudinal axis (6) intersects. The neck (10) comprises neck threading (9) disposed on the exterior of the neck (10). Below the neck threading (9) (along the longitudinal axis (6)), a neck ring (13) extends circumferentially around the exterior of the neck (10). The top portion (14) comprises a first protrusion (41) and a second protrusion (42) disposed thereon. The first and second protrusions (41, 42) are adjacent to the neck (10) and are on opposing sides of the neck (10). Preferably, although not shown, the first and second protrusion are opposing each other and intersect a molding seam (of the top portion (14) of the container body (5)). Preferably at least the first protrusion (41), is bulbous, preferably having a surface area from 5 $mm^2$ to 15 $mm^2$, preferably from 6 $mm^2$ to 11 $mm^2$. Preferably the second protrusion (42) is also bulbous, also preferably having a surface area from 5 $mm^2$ to 15 $mm^2$, preferably from 6 $mm^2$ to 11 $mm^2$. In another example, the first and/or second protrusion (41, 42) may have height from 1 mm to 5 mm, preferably from 2 to 3 mm.

One advantage of the package herein described herein, is minimizing the freedom of movement of the shoulder (11) (when functionally attached to the container body (5) and neck (10)). That is, when the first notching tooth (31) engages the first protrusion (41), and preferably the second notching tooth (32) engages the second protrusion (42). In one example, the functionally attached shoulder (11) has a rotationally degree of freedom around the longitudinal axis (6) without glue or adhesive applied thereto of less than 3 degrees, preferably from 0.1 to 2 degrees, more preferably 0.1 to 1 degree. In one example, the functionally attached shoulder (11) has a vertical degree of freedom along the longitudinal axis (6) without glue or adhesive applied thereto of less than 2 mm, preferably 0.1 to 1 mm, more preferably 0.1 to 0.5 mm.

One aspect of the invention provides for a method making a package (1). A step in this method is molding, by way of a two-piece mold a container (17), preferably a glass container (17), wherein the container (17) has a container body (5) and neck (10) as previously described. Another step is providing a shoulder (11) as previously described. Another step is functionally attaching the shoulder (11) to the molded container body (5) by pushing the shoulder (11) over the neck (10) along the longitudinal axis (6) so that first flexing tooth (21) flexes over the neck ring (13) and at least the first notching tooth (31) engages with the first protrusion (41). One or more optional steps include filling the container body (5) with the personal care composition; and/or attaching a removably attachable dispenser (12) (as previously described) to the neck (10)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for a personal care product comprising:

a longitudinal axis;

a container body, capable of containing a personal care composition, comprises a top portion circumscribing the longitudinal axis, wherein the top portion comprises a first protrusion disposed thereon;

a neck extending from the top portion along the longitudinal axis, wherein the neck comprises: a neck opening in fluid communication with an interior of the container body; and a neck ring at least partially extending circumferentially around an exterior of the neck;

a dispenser removably attached to the neck and in fluid communication with an interior of the container body; and a shoulder comprising a plurality of teeth defining an interior concentric opening in an interior of the shoulder, wherein the plurality of teeth comprise: a first flexing tooth configured to flex over and engage with the neck ring; and a first notching tooth configured to engage the first protrusion, when the shoulder is functionally attached to the container body and neck.

2. The package of claim 1, wherein the first notching tooth comprises a notch portion.

3. The package of claim 2, wherein the notch portion comprises a first rib and a second rib opposing each other in angular relationship.

4. The package of claim 3, wherein an angle defining the angular relationship of the opposing ribs is between 15 and 90 degrees.

5. The package of 1, wherein the first notching tooth comprises first and second ribs disposed on an underneath surface of the first notching tooth as to engage the first protrusion.

6. The package of claim 1, wherein the shoulder covers the first protrusion.

7. The package of claim 6, wherein the shoulder further comprises a skirt portion circumferentially extending outwardly from the interior concentric opening and contacting the top portion.

8. The package of claim 1, further comprising a shoulder fascia, wherein said shoulder fascia is attached over the functionally attached shoulder.

9. The package of claim 1, wherein the top portion further comprises a second protrusion, wherein the plurality of teeth further comprise a second notching tooth, wherein the second notching tooth is configured to engage the second protrusion, when the shoulder is functionally attached to the container body and neck.

10. The package of claim 9, wherein the second protrusion is opposing the first protrusion.

11. The package of claim 1, wherein at least the first protrusion, is bulbous and has a surface area of about 5 $mm^2$ to about 15 $mm^2$.

12. The package claim 1, wherein said plurality of teeth further comprise a second flexing tooth.

13. The package of claim 1, wherein said plurality of teeth further comprise a first non-flexing tooth and a second non-flexing opposed to one another.

14. The package of claim 1, wherein the functionally attached shoulder has a rotationally degree of freedom around the longitudinal axis without glue or adhesive applied thereto of less than 3 degrees.

15. The package of claim 1, wherein the functionally attached shoulder has a vertical degree of freedom along the longitudinal axis without glue or adhesive applied thereto of less than 2 mm.

16. The package of claim 1, wherein the container body and neck are molded glass.

17. The package of claim 1, wherein the dispenser comprises a pipette a squeezable bulb and a collar, wherein the pipette has an opening and the collar is disposed between the squeezable bulb and the pipette opening.

18. The package of claim 1, further comprising a personal care composition contained in the container body.

* * * * *